US012745880B1

(12) United States Patent
Roy

(10) Patent No.: US 12,745,880 B1
(45) Date of Patent: Sep. 29, 2026

(54) LUXURY BATH AND SHOWER SYSTEM

(71) Applicant: Arjun Roy, Danville, CA (US)

(72) Inventor: Arjun Roy, Danville, CA (US)

( * ) Notice: Subject to any disclaimer, the term of this patent is extended or adjusted under 35 U.S.C. 154(b) by 75 days.

(21) Appl. No.: 19/039,929

(22) Filed: Jan. 29, 2025

Related U.S. Application Data

(60) Provisional application No. 63/566,449, filed on Mar. 18, 2024.

(51) Int. Cl.
*A47K 3/022* (2006.01)
*A47K 3/28* (2006.01)
*A47K 17/02* (2006.01)

(52) U.S. Cl.
CPC ..... *A47K 3/022* (2013.01); *A47K 3/282* (2013.01); *A47K 17/022* (2013.01)

(58) Field of Classification Search
CPC ..... A47K 3/022; A47K 3/282; A47K 17/022
See application file for complete search history.

(56) References Cited

U.S. PATENT DOCUMENTS 4,068,326 A 1/1978 Deschler
6,378,147 B1 * 4/2002 Halleran ..... A47K 3/122 4/583
D1,126,616 S * 5/2026 Roy ..... D6/377
2004/0031094 A1 2/2004 Sanpetrino et al.
2004/0073996 A1 * 4/2004 Hill ..... A61H 7/001 4/584
2006/0207016 A1 * 9/2006 Lev ..... A61H 33/6089 4/622
2009/0306277 A1 12/2009 Goenner et al.
2009/0307835 A1 12/2009 Anastasi Vavvessi
2010/0115692 A1 * 5/2010 Fowkes ..... A47K 3/12 4/579
2019/0183293 A1 * 6/2019 Day ..... A47K 3/122
2022/0192865 A1 * 6/2022 Hughett, Sr. ..... A61F 7/0097

FOREIGN PATENT DOCUMENTS

CN 204814786 U 12/2015

* cited by examiner

*Primary Examiner* — Christine J Skubinna
(74) *Attorney, Agent, or Firm* — John Rizvi; John Rizvi, P.A.—The Patent Professor®

(57) ABSTRACT

A luxury bath and/or shower system configured to provide an enhanced bath and/or shower experience to a user comprises a bath/shower structure, a system housing installed in a frame of the shower or bath structure, a silicone enclosure configured for storage in the housing, an enclosure deployment and retraction apparatus for deployment of the enclosure from a first configuration stored within the housing and a second configuration deployed to an interior portion of the bath/shower structure, and a system control. The silicone enclosure comprises a sealed exterior compartment and at least one plastic or silicone interior membrane which define a plurality of interior compartments configured to contain a non-Newtonian fluid. A user may operate the control to deploy and retract the enclosure. A plurality of balls of different sizes may be contained in non-Newtonian fluid to provide a luxurious, gently undulating support to the user.

20 Claims, 12 Drawing Sheets

LUXURY BATH AND SHOWER SYSTEM

CROSS-REFERENCE TO RELATED APPLICATIONS

This application claims the benefit of U.S. Provisional Patent Application Ser. No. 63/566,449, filed on Mar. 18, 2024, which is incorporated by reference herein in its entirety.

FIELD OF THE INVENTION

The present invention relates generally to baths and showers, and more particularly to a luxury bath/shower system including an enclosure filled with a non-Newtonian fluid.

BACKGROUND OF THE INVENTION

Swimming pools, lap pools and hot tubs have been developed which have a vinyl liner. Bath mats and bathtubs with a soft gel interior have been developed.

For example, some options include a tub having a soft gel interior that is designed to reduce muscle tension, soreness, and fatigue while providing comfort, relaxation, and rejuvenation. Such options are formed in the shape of a human body posterior and include vibrating elements, equipped with various settings, to apply therapy and relief to aching joints and muscles, and include a thermostatic heating system and a sound system.

Some options include gel coating including resin systems comprising a crosslinkable resin, a reactive diluent, and a plurality of reactive, surface-modified nanoparticles which may be incorporated into surfaces of various articles.

Some options include bathtub cushions comprising a mat sized and shaped to fit on a bottom of a bathtub, a cushion coupled to and constrained by the mat and at least one attachment device coupled to the mat to retain the mat on the bottom of the bathtub. The cushion may comprise a plurality of separate and distinct cushions circumscribed by the mat.

Some options include a bath which comprises a support of foamed polymeric material, substantially soft, suitable for defining a volume suitable for being filled with water or other liquid intended for sanitary purposes, with a coating covering at least a portion of the support. The coating is made mosaic-wise by a plurality of blocks exhibiting structural stiffness higher than the support.

Many cushions are known to be flimsy and lacking in both comfort and durability and not well adapted for conventional use in lounging comfortably. Fluid pad assemblies may be used for bed-stricken or wheelchair-bound users.

Also, non-Newtonian fluid mattresses exist for use on or in place of conventional bed mattresses. Such non-Newtonian fluid mattresses may include a first cushion layer arranged on an uppermost layer attachable to a human body of a user; a second cushion layer arranged below the first cushion layer and having an upper surface provided with a plurality of groove bodies filled with a non-Newtonian fluid; and a third cushion layer arranged at beneath the second cushion layer configured to support the second cushion layer. The groove bodies of the second layer are configured to change viscosity of the non-Newtonian fluid by pressure or speed of fluid flow to adjust the pressure and firmness provided by the mattress to accommodate different human comfort levels of the user.

Pads for targeted temperature management of users such as medical patients exist which may include a pad body made of a material configured to conform to a body of a user positioned thereon, a conduit system, one or more inlets, and one or more outlets. The conduit system can be disposed in the pad body or an overlayer configured for placement over the pad body. The conduit system can include one or more conduits configured to convey a fluid through the pad body or the overlayer. The one-or-more inlets can be configured for charging the conduit system with the fluid, while the one-or-more outlets can be configured for discharging the fluid from the conduit system. Methods of the systems and pads can include methods of use. In another example, a deformable pad can be configured for receiving a neonatal patient.

Deformable chairs also exist for use by infants which may be attached to a surface, which have a deformable peripheral annular portion, and a restoring means provided at a center side of the annular portion configured to providing a restoring force to restore the deformable annular portion to an undeformed shape, and a downwardly opening space portion. The restoring means may comprise a fluid filling portion that can be filled with fluid. A support portion for supporting a seated infant is provided on a center side of the restoring means.

Massage chairs exist which offer a relaxing stretching experience while one's position is restricted, but no option exists for unrestricted safe movement while a user is luxuriating in the comfort of a bath or a warm shower. There are pools wherein the bather has many degrees of freedom to move but not to experience the relaxing undulation of soft skin-like surface under him/her in which to feel supported and pampered. There are hot tubs which offer a more static experience of comfort and warmth; however, they do not allow the sense of freedom of movement nor the luxury of compliant support of fluid filled silicone. There are nonslip bath mats which again, do not offer an enhanced degree of luxury, comfort, relaxation and safety of a soft fluid-filled surface.

Ideally, it would be extremely useful to be able to provide comfort and unrestricted safe movement while a user is luxuriating in the comfort of a bath or a warm shower.

Accordingly, there is a need for a solution to at least one of the aforementioned problems. For instance, there is an established need for a preferably a bath or shower that provide for safe movement with many degrees of freedom, and a soft supported pampering experience of compliant fluid filled silicone.

SUMMARY OF THE INVENTION

Accordingly, the present invention provides a luxury bath and shower system. The luxury bath/shower system includes a bath and/or shower surface lining incorporating a loose, soft silicone 'bag" containing a non-Newtonian fluid in single or multiple layers, with characteristics to enhance safety and/or luxury in the shower and/or bathing space. The system is configured to provide a user unrestricted safe movement while luxuriating in the comfort of a bath or a warm shower.

In one implementation, the present invention provides a luxury bath/shower system configured to provide a user an enhanced bath/shower experience to a user, the system comprising: a bath/shower structure having a frame and an interior portion;

- a system housing installed in the frame of the bath/shower structure;
- a silicone enclosure configured for storage in the system housing;

an enclosure deployment and retraction apparatus for deployment of the silicone enclosure from a first undeployed enclosure configuration stored within the system housing and a second deployed enclosure configuration deployed to the interior portion of the bath/shower structure; and at least one system control device configured for use by the user to power on the system and to control a plurality of system functions and a plurality of system settings, the at least one system control device being operably connected to the enclosure deployment and retraction apparatus;

wherein the silicone enclosure comprises a sealed exterior compartment and at least one interior membrane of plastic or silicone;

wherein the silicone enclosure and the at least one interior membrane define a plurality of interior compartment layers and a plurality of interior compartments;

wherein each interior compartment of said plurality of interior compartments is configured to contain a quantity of a non-Newtonian fluid;

wherein the plurality of interior compartment layers comprise a first compartment layer and a second compartment layer and the plurality of interior compartments comprise a first interior compartment configured to contain a quantity of a non-Newtonian fluid and a second interior compartment configured to retain a quantity of a non-Newtonian fluid; and wherein a user may operate the system control device to deploy and retract the silicone enclosure;

wherein the enclosure deployment and retraction apparatus comprises:

at least one pump;

a first linear track having a first end and a second end;

a second linear track having a first end and a second end;

a first sled configured for movement on the first track from a first undeployed position at the first end of the first linear track and a second deployed position at the second end of the first linear track;

a second sled configured for movement on the second track from a first undeployed position at the first end of the second linear track and a second deployed position at the second end of the second linear track;

wherein the first sled is attached to the silicone enclosure; and wherein the second sled is attached to the silicone enclosure;

wherein in response to the activation of the enclosure deployment apparatus to operate the pump and to deploy the silicone enclosure, the first sled travels along the first track from the first undeployed position to the second deployed position and the second sled travels along the second track from the first undeployed position to the second deployed position for deployment of the silicone enclosure from the first undeployed enclosure configuration to the second deployed enclosure configuration deployed to the interior portion of the bath/shower structure.

The structural components of the luxury bath system may include a bath or shower structure, a soft silicone enclosure with non-Newtonian fluids therein, fixation means comprising adhesives for which are stable in a moist environment and at varying temperatures. Silicone or rubber balls may optionally be included in the non-Newtonian fluids.

The system and its components may be made of any suitable materials, and may be fabricated by any suitable fabrication process.

The shower and bath structures may be a conventional bath with a system housing or a shower structure. The system housing and the shower structure may be made of high tensile strength glass, with water tight doors and seals. The seals may be provided on any system components to provide a water tight environment. The seals may be made of any suitable material such as silicone or silicone rubber.

In one aspect, the silicone enclosure may be made of any suitable soft silicone material having properties including durability, high shear strength and soft, skin-like tactile texture. Nonlimiting examples of such a material may include high compliance silicone rubber and/or high consistency silicone rubber having properties including durability, high sheer strength and soft, skin-like tactile texture.

In one aspect, the at least one interior membrane may be made of any suitable plastic or silicone material.

In one aspect, the at least one interior membrane may comprise a plurality of interior membranes. In one aspect, the plurality of interior membranes may comprise a first interior membrane and a second interior membrane. The silicone enclosure, the first interior membrane and the second interior membrane may define a plurality of interior compartment layers and a plurality of interior compartments. Each interior compartment may contain a non-Newtonian fluid. At least one interior compartment may further contain a plurality of balls. In one aspect, the plurality of balls may comprise three balls. In one aspect, the plurality of balls may be of different sizes configured to provide a luxurious, gently undulating support to a user.

In one aspect, the non-Newtonian fluids may be any suitable non-Newtonian fluid having varying viscosities, with varying particulate concentrations, shapes and textures. The non-Newtonian fluids are stable at varying temperatures. The non-Newtonian fluids may be configured to enhance the luxury bath/shower experience.

In one aspect, a plurality of balls of different sizes may be provided in different layers of non-Newtonian fluid to vary the experience. In one aspect, the plurality of balls may comprise silicone or rubber balls of any suitable size and dimensions. Nonlimiting examples of suitable silicone or rubber balls may have a size and dimensions ranging from about the size of a grapefruit to about the size of a beach ball.

In one aspect, the adhesives may comprise epoxy resin, which is stable in a moist environment and at varying temperatures.

In one aspect, the silicone enclosures may incorporate roller mechanisms, of the kind found in massage chairs. The silicone enclosures may also incorporate panels to create wave effects in the non-Newtonian fluids.

In one aspect, the system may include a system control device, which may be one or more of a system control panel located in the bath/shower or on a bathroom wall, and a system remote control device. The system control device may be used to power on the system, and operate the enclosure deployment and retraction apparatus. The system control device may be used to operate additional system functions as described herein. In one aspect, the system control panel further includes a control which deploys the plurality of balls to create a floating sensation. In one aspect, the system control panel may further provide one or more of a lighting control, a music control and a system temperature control. In one aspect, the system includes other optional enhancements, such as, for example without limitation, internal speakers and a wireless control to access music so the system may further provide mood lighting and music. The system may optionally provide a voice-activated control feature.

The system may include various electronic and computer components so that the system may be programmable to provide safe and luxury experiences in a "smart shower" setting. For example, the enclosure deployment and retraction apparatus may include at least one pump. The system control device may include a "smart shower" setting configured to control the at least one pump to adjust the volume of the non-Newtonian fluid to optimize for settings such as safe bathing mode or luxury bath/shower mode. The at least one pump may further be configured to retract or undeploy the non-Newtonian fluid in connection with retraction or undeployment of the silicone enclosure.

In one aspect, the luxury bath/shower system is constructed and arranged to enhance the bathing/showering experience, and to create a safer bathing and showering environment. The soft silicone encloses a non-Newtonian fluid of particular thixotropic properties in sufficient volume to line the surfaces of bathing and shower spaces to impart a warm womb-like luxury and degree of freedom of movement to the bathing/showering experience. Optimally, while bathing, the user will have a floating and deeply relaxing experience. The experience may include further system enhancements provided by gentle waves, stretching, and/or massaging effects provided by the action of panels to generate gentle waves in the non-Newtonian fluid, or by agitating different sized balls in deeper layers of the non-Newtonian fluid with underlying rollers.

In one aspect, the system may be incorporated into a conventional bath tub or a conventional shower. The housing may be used to store the silicone enclosure and at least one non-Newtonian fluid. In some embodiments the silicone enclosure may contain a plurality of non-Newtonian fluids, for example, a first non-Newtonian fluid and a second non-Newtonian fluid.

In one aspect, the silicone enclosure may be associated with an enclosure deployment apparatus. The enclosure deployment apparatus may comprise a first sled and a second sled tethered or attached to the silicone enclosure. The enclosure deployment apparatus may further comprise a first track having a first proximal end and a second distal end, and a second track having a first proximal end and a second distal end. The enclosure deployment apparatus may further comprise at least one pump. In use, the enclosure deployment apparatus and the pump may be controlled by the control panel or the remote control. A user may operate the system to actuate the at least one pump to deploy the silicone enclosure and the at least one non-Newtonian fluid from a stowing space in the housing. In response to operation of the pump, the first sled is will travel distally from the housing on the first track into the bath or shower, and the second sled will travel distally from the housing on the second track into the bath or shower. The user may then use the system in the bath or shower either reclining or standing. When using the system in a bath, the user may recline and be supported by the silicone enclosure in a manner somewhat similar to sitting in a beanbag chair, with the non-Newtonian fluid and the silicone enclosure distributing around the user. When using the system in a shower, the user may stand with the user's weight on the user's feet, and the silicone enclosure may surround at least a portion of the user, with the silicone surface surrounding the user, and with the displacement of the non-Newtonian fluid in the silicone enclosure around the user similar to a beanbag. The system control panel or the system remote control may be used to operate the system with different settings to control the at least one pump, to control the volume of non-Newtonian fluid to permit displacement of the non-Newtonian fluid, and to permit the system to provide safety cushioning to the user in the bath/shower. After the user is finished using the system, the user may operate the system to actuate the at least one pump to retract or undeploy the non-Newtonian fluid and the silicone enclosure proximally back into the housing stowing space B where the silicone enclosure may be stowed or stored between uses of the system.

In one aspect, the silicone enclosure surface provides to the bathing and shower spaces a soft silicone lining, in which is enclosed non-Newtonian fluid of particular thixotropic properties in sufficient volume, which imparts a warm womb-like luxury and degree of freedom of movement to the bathing/showering experience. Optimally the bather will have a floating and deeply relaxing experience, which may be further enhanced by gentle wave, stretching and/or massaging effects provided by the action of panels to generate gentle waves in the non-Newtonian fluid, or different sized balls located in deeper layers of the non-Newtonian fluid agitated by the action of underlying rollers. The system may also provide mood lighting and music.

In one aspect, the unprecedented luxury bath system of the present invention distinguishes over previous solutions, which are few and include massage chairs, swimming pools and hot tubs. Previous solutions include existing massage chairs which offer a relaxing stretching experience while the position of the user is restricted. The system of the present invention permits unrestricted safe movement of the user while the user may luxuriate in the safety and comfort of a warm shower. Previous solutions also include swimming pools where the user/bather has many degrees of physical freedom to move, but does not experience the relaxing undulation of a soft skin-like surface or lining beneath the user which supports the user and provides an experience of feeling supported and pampered. Previous solutions also include spas or hot tubs which offer a more static experience of comfort and warmth, but do not permit the freedom of movement or the luxury of compliant support of fluid filled silicone. Finally, previous solutions also include nonslip bath mats for use in an existing bath/shower which fail to offer the relaxation the luxury bath system of the present invention provides, and fail to offer the safety of the soft fluid-filled surface of the present invention.

In one aspect, the system of the present invention may be beneficially used in a therapeutic manner to provide a safe and comfortable bathing experience to users. As a medical doctor, the inventor has seen many injuries due to slip and fall accidents on slippery and hard bathing surfaces, as well as infections and disease from poor hygiene and unwashed inaccessible areas in frail individuals who are not able to optimally position themselves to clean in hard to reach areas. In one aspect, the surface of the silicone enclosure, with appropriate underlying volume and non-Newtonian fluid consistency, is a safe, easy and comfortable bathing environment for those of frail health. It allows for positioning and movement to wash and clean with ease with minimal risk of injury.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a luxury bath/shower system 100, hereinafter system 100. The system is configured to provide a user 102 an enhanced bath/shower experience.

Figure 1:
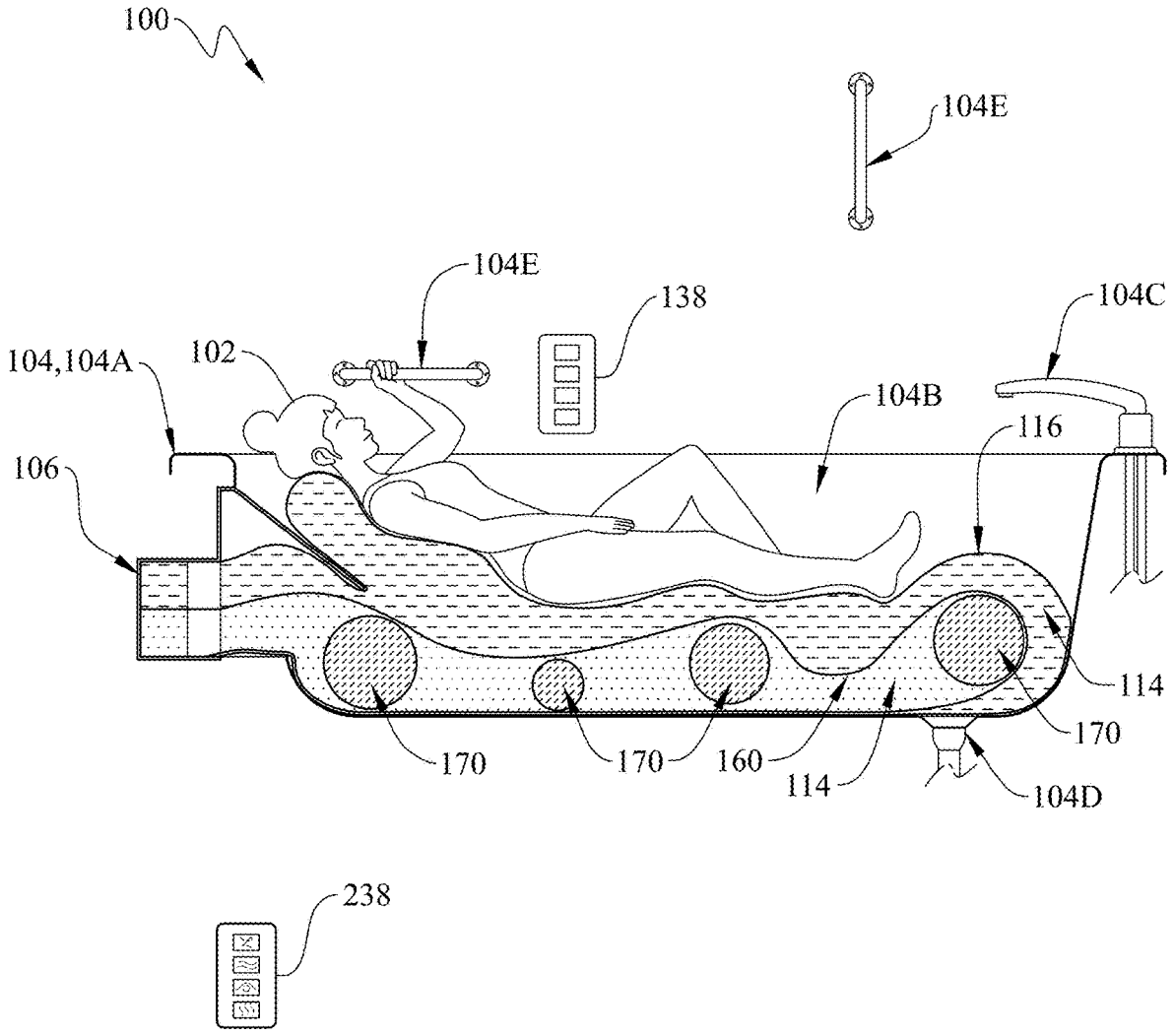
FIG. 1 presents a side elevational view with a partial cross-section of a luxury bath and shower system, in accordance with an embodiment of the present invention, shown in use.
Figure 2:
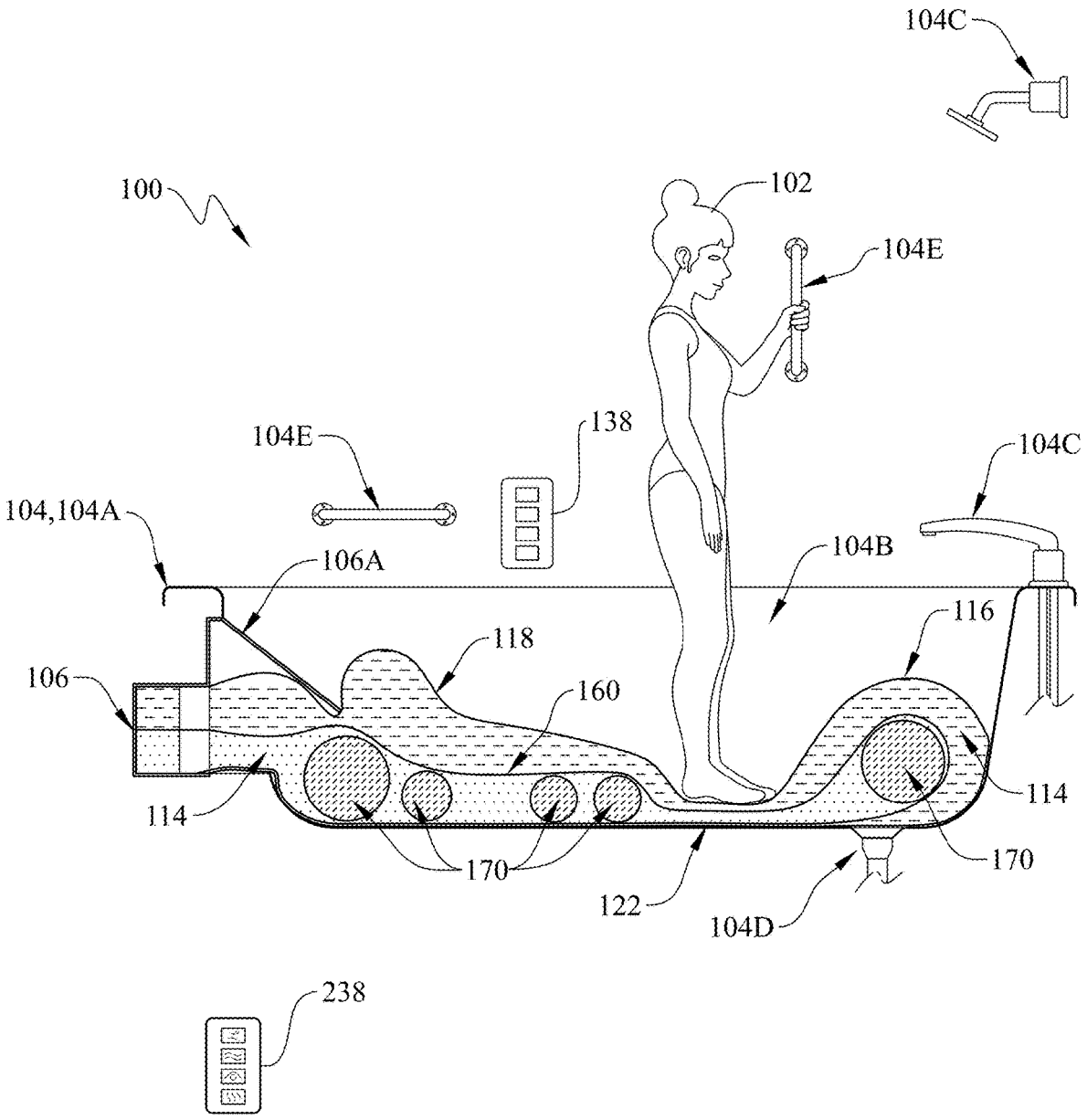
FIG. 2 presents a side elevational view with a partial cross-section of a luxury bath and shower system, in accordance with an embodiment of the present invention, shown in use.
Figure 3:
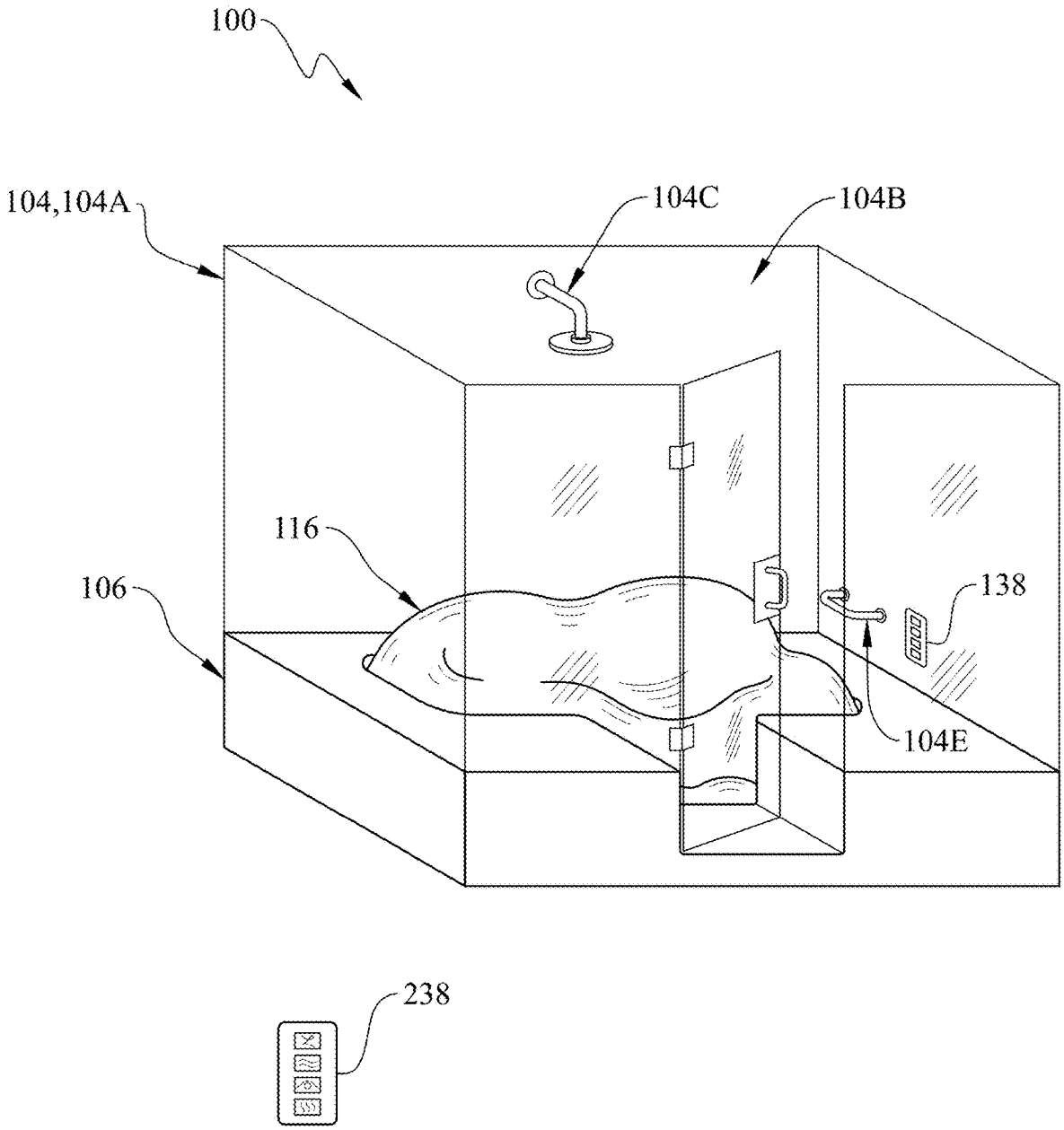
FIG. 3 presents a perspective view of a luxury bath and shower system in accordance with the present invention which comprises a walk-in shower, showing the silicone enclosure deployed.

Referring to FIG. 1-FIG. 7, the system 100 comprises a bath/shower structure 104 having a frame 104A and an interior portion 104B. As shown at FIGS. 1-2, the bath/shower structure 104 may be a bathtub or a bathtub/shower. As shown at FIG. 3, the bath/shower structure 104 may be a walk-in shower. The bath/shower structure 104 also has a conventional faucet or shower head 104C (the faucet 104C being shown at FIGS. 1-2 and 5-7 and the shower head 104C being shown at FIGS. 2-3), a drain 104D (best seen at FIGS. 1-2 and 5-7) and at least one safety handle 104E. A system housing 106 is installed in the frame 104A of the bath/shower structure 104. A silicone enclosure 116 is configured for storage in the system housing 106.

Figure 4:
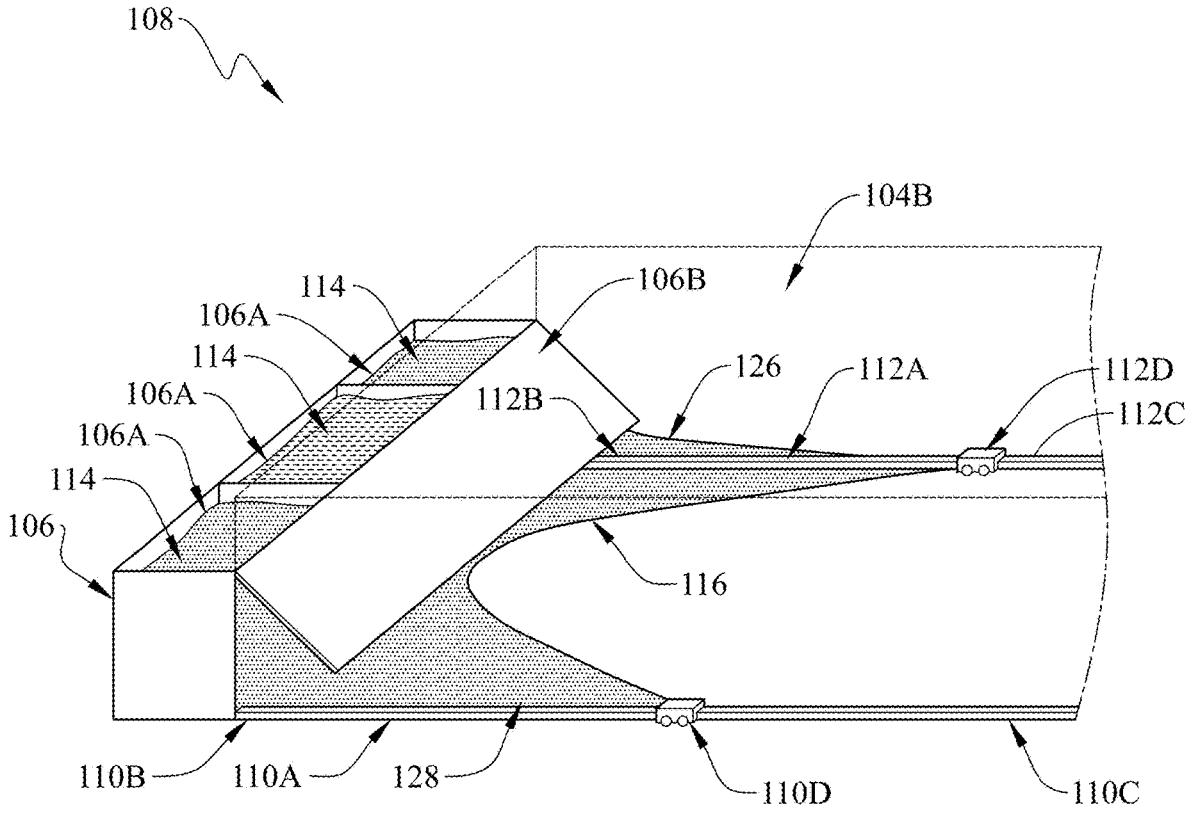
FIG. 4 presents a perspective view of a luxury bath/shower system housing and enclosure deployment and retraction apparatus for deployment of the silicone enclosure, of the system as in FIG. 1 and FIG. 2.
Figure 5:
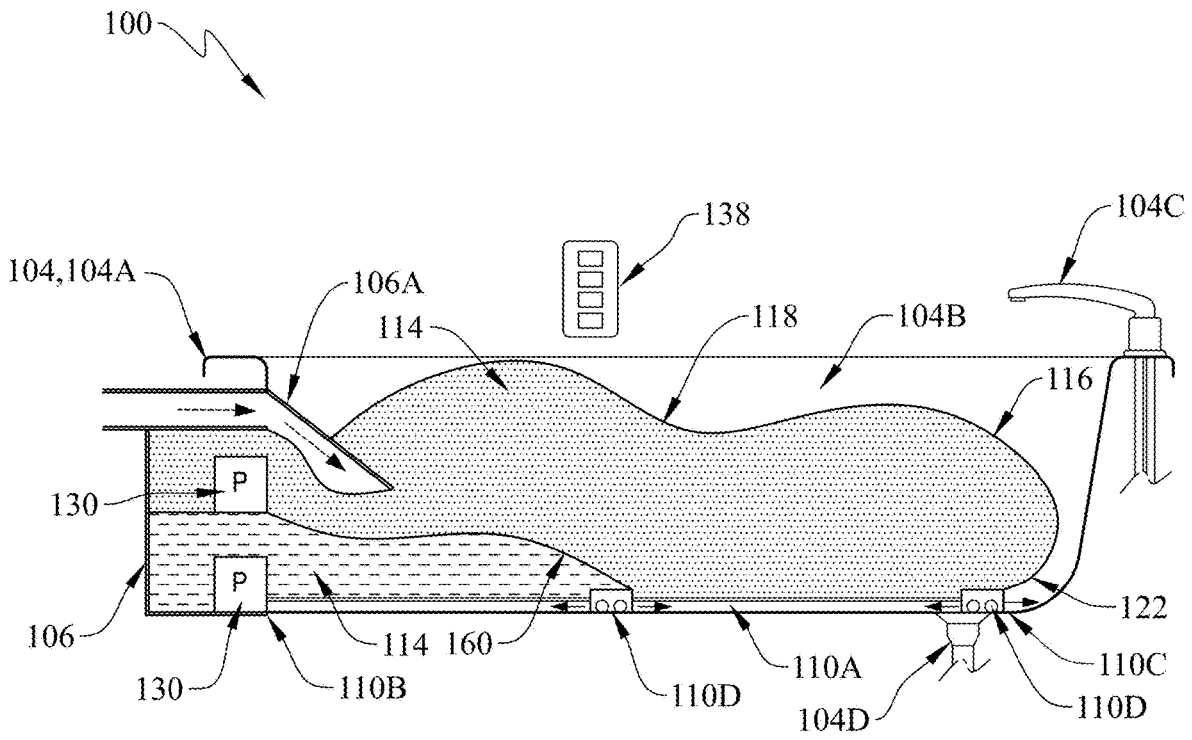
FIG. 5 presents a cross-sectional side elevational view of the luxury bath/shower system.

As shown at FIG. 4, an enclosure deployment and retraction apparatus 108 for deployment of the silicone enclosure 116 from a first undeployed enclosure configuration stored within the system housing 106 and a second deployed enclosure configuration deployed to the interior portion 104B of the bath/shower structure 104. At FIGS. 1-3, the silicone enclosure is shown in the second deployed enclosure configuration or position.

At least one system control device 138,238 is configured for use by the user 102 to power on the system 100 and to control a plurality of system functions and a plurality of system settings, the at least one system control device 138,238 being operably connected to the enclosure deployment and retraction apparatus 108. The user 102 may operate the system control device 138,238 to deploy and retract the silicone enclosure 116.

The silicone enclosure 116 has a top surface 118 (see FIG. 2), a bottom surface 122 (see FIG. 2), a right side 126 (see FIG. 4) and a left side 128 (see FIG. 4). The silicone enclosure 116 defines a sealed exterior compartment 116. The system 100 comprises at least one interior membrane 160 of plastic or silicone. The exterior compartment 116 and the at least one interior membrane 160 define a plurality of interior compartment layers and a plurality of interior compartments.

Figure 6:
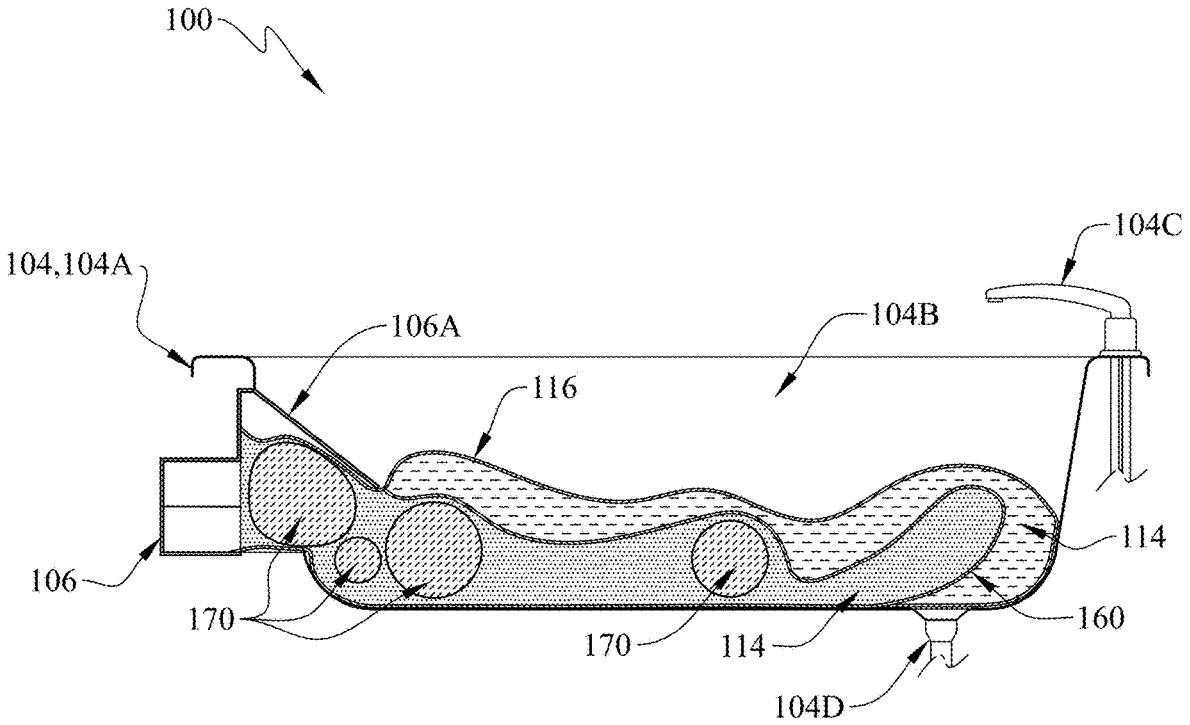
FIG. 6 presents a cross-sectional side elevational view of the luxury bath/shower system.
Figure 7:
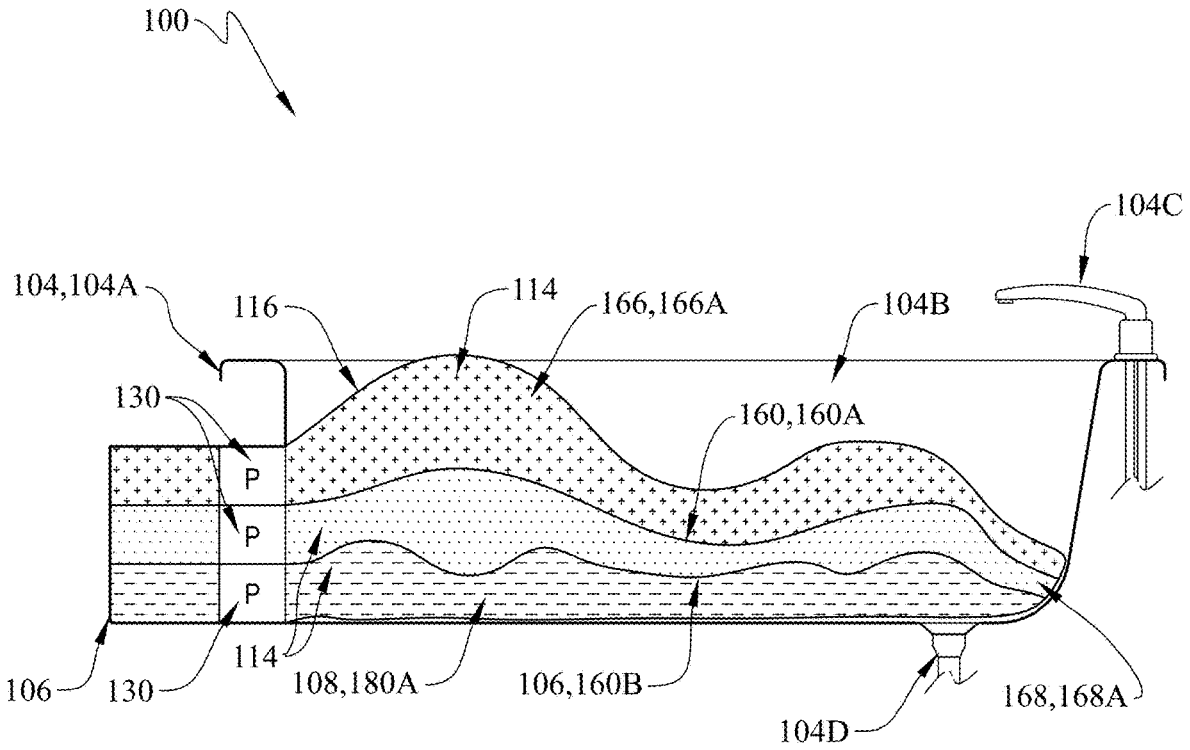
FIG. 7 presents a cross-sectional side elevational view of the luxury bath/shower system.

The at least one interior membrane 160 may comprise a plurality of interior membranes 160 as shown at FIG. 6. As shown at FIG. 7, the plurality of interior membranes 160 may comprise a first interior membrane 160A and a second interior membrane 160B. The plurality of interior compartment layers may comprise a top or uppermost layer 166 and a bottom or lowermost layer 180. The plurality of interior compartments may comprise a top or uppermost interior compartment 166A and a bottom or lowermost interior compartment 180A. Each interior compartment may contain a non-Newtonian fluid. For example, the top interior compartment 166A may contain a non-Newtonian fluid 114, and the bottom interior compartment 180A may contain a non-Newtonian fluid 114.

As shown at FIG. 7, the plurality of interior membranes 160 may comprise a first interior membrane 160A and a second interior membrane 160B. The exterior compartment 116, the first interior membrane 160A and the second interior membrane 160B define a plurality of interior compartment layers 166, 168, 180 and a plurality of interior compartments 166A, 168A, 180A. Each interior compartment 166A, 168A, 180A may contain a non-Newtonian fluid 114.

The interior compartments may contain a plurality of balls 170 as shown at FIG. 2 and FIG. 6. The balls 170 may be of different sizes to provide a luxurious, gently undulating support to a user.

Best seen at FIG. 4, the enclosure deployment and retraction apparatus 108 comprises a first linear track 110A having a first end 110B and a second end 110C and a second linear track 112A having a first end 112B and a second end 112C. The enclosure deployment and retraction apparatus 108 further comprises a first sled 110D configured for movement on the first linear track 110A from a first undeployed position at the first end 110B of the first linear track 110A and a second deployed position at the second end 110C of the first linear track 110A and a second sled 112D configured for movement on the second linear track 112A from a first undeployed position at the first end 112B of the second linear track 112A and a second deployed position at the second end 112C of the second linear track 112A. The enclosure deployment and retraction apparatus 108 further comprises at least one pump 130. The first sled 110D is attached to the silicone enclosure and the second sled 112D is attached to the silicone enclosure 116.

In response to the activation of the enclosure deployment and retraction apparatus 108 to deploy the silicone enclosure 116, the first sled 110D travels along the first linear track 110A from the first undeployed position to the second deployed position and the second sled 112D travels along the second linear track 112A from the first undeployed position to the second deployed position for deployment of the silicone enclosure 116 from the first undeployed enclosure configuration to the second deployed enclosure configuration deployed to the interior portion 104B of the bath/shower structure 104.

The enclosure deployment and retraction apparatus 108 and the pump 130 may be controlled by the system control panel 138 or the system remote control 238. In use, the enclosure deployment and retraction apparatus 108 and the pump 130 may be actuated by the user 102. The user 102 may operate the system 100 to actuate the at least one pump 130 to deploy the silicone enclosure and the at least one non-Newtonian fluid 114 from the stowing space 106A of the housing 106. In some embodiments a vertical housing door 106B is pivotally mounted to the housing 106. In response to operation of the at least one pump 130, the first sled 110D will travel distally from the housing 106 on the first track 110A into the bath/shower interior 104B, and the second sled 112D will travel distally from the housing 106 on the second track 112A into the bath/shower interior 104B.

In use, the user 102 may access the system control device 138,238, which may be one or more of a system control panel 138 located in the bath/shower or on a bathroom wall, and the system remote control device 238 which may be a hand held device. The system 100 may include various electronic and computer components so that the system may be programmable to provide safe and luxury experiences in a "smart shower" setting. For example, the enclosure deployment and retraction apparatus 108 and the at least one pump 130 may be operated by the control device 138,238. The system control device 138,238 may include a "smart shower" setting configured to control the at least one pump 130 to adjust the volume of the non-Newtonian fluid 114 to optimize for settings such as safe bathing mode or luxury bath/shower mode. The at least one pump 130 may further be configured to retract or undeploy the non-Newtonian fluid 114 in connection with retraction or undeployment of the silicone enclosure 116. The deployed enclosure 116 is shown at FIGS. 1-3 and FIGS. 5-7.

The user 102 may then use the system 100 in the bath or shower interior 104B either reclining or standing. When using the system 100 in a bath, the user may recline and be supported by the silicone enclosure 116 in a manner somewhat similar to sitting in a beanbag chair, with the non-Newtonian fluid 114 and the silicone enclosure 116 distributing around the user. When using the system in a shower, the user may stand with the user's weight on the user's feet, and the silicone enclosure 116 may surround at least a portion of the user, with the silicone surface surrounding the user, and with the displacement of the non-Newtonian fluid 114 in the silicone enclosure 116 around the user similar to a beanbag. The system control panel 138 or the system remote control 238 may be used to operate the system with different settings to control the at least one pump 130, to control the volume of non-Newtonian fluid 114 to permit displacement of the non-Newtonian fluid 114, and to permit the system 100 to provide safety cushioning to the user in the bath/shower. After the user is finished using the system 100, the user may operate the system to actuate the at least one pump 130 to retract or undeploy the non-Newtonian fluid 114 and the silicone enclosure 116 proximally back into the housing 106 stowing space B where the silicone enclosure 116 may be stowed or stored between uses of the system 100.

Figure 8:
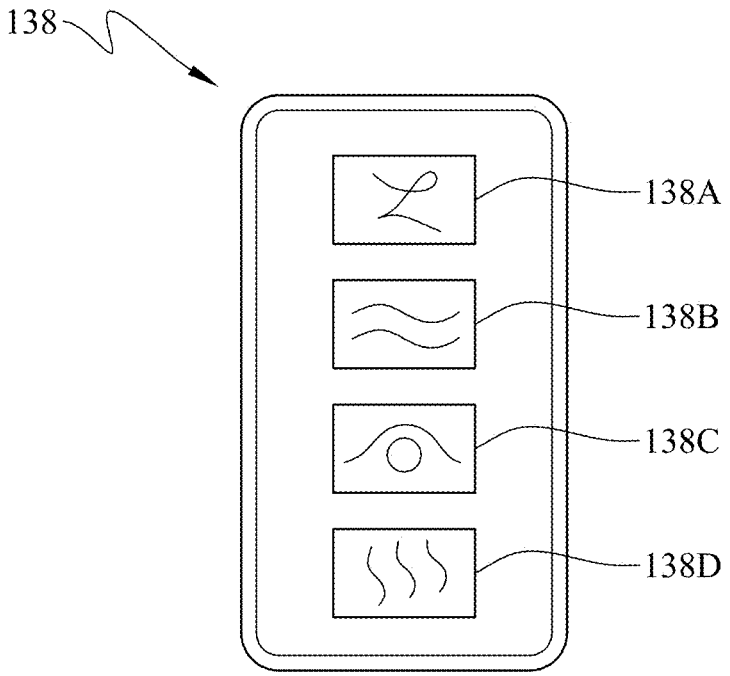
FIG. 8 presents a top view of a control panel of a luxury bath/shower system as in FIG. 1 and FIG. 2, enlarged to show detail.
Figure 9:
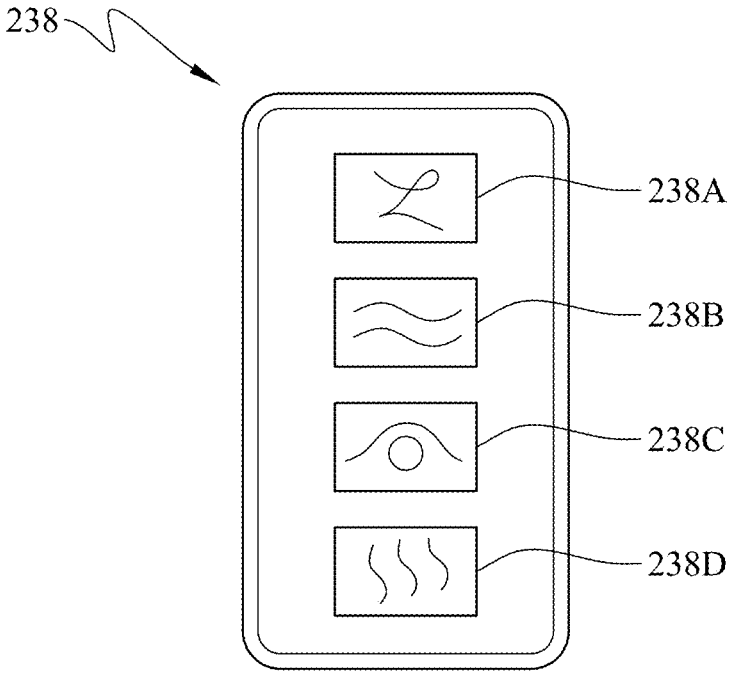
FIG. 9 presents a top view of a remote control of a luxury bath/shower system as in FIG. 1 and FIG. 2, enlarged to show detail.

Referring to FIG. 8, the system control panel 138 may include a power switch 138A and system controls 138B, 138C and 138D. Referring to FIG. 9, the system remote control 238 may include a power switch 238A and system controls 138B,138C and 138D. The control panel 138 and the system remote control 238 may further include a control which deploys the plurality of balls 170 to create a lounge floating sensation, and a temperature control means. The system 100 may include other optional enhancements. For example without limitation, the system 100 may include internal speakers and a wireless control to access music. The control panel 138 and the remote control 238 may also incorporate a stereo, television or cable remote control, or a voice-activated control feature.

In some embodiments, the power switch 138A,238A may deploy and secure the silicone enclosure, and operate the pump 130 which functions for disposition of the non-Newtonian fluid 114. A floating control 138B,238B may be used to release and secure the texture balls 170.

Slide switches 138C,238C and 138D,238D may be used to control wave action, mood lighting and music. For example, slide switches 138C,238C may be used as a wave switch, which when activated may actuate relaxing undulating wave action in the fluid, and stir the texture balls, enhancing the sensation of floating on a cloud. The action may be made progressively more stimulating by sliding the switch. At its maximum, vibrating massaging action may be experienced. Slide switches 138D,238D may be used as a music button, which may actuate one of several built-in programs to synchronize with wave action and lighting to create mood, or interface with an app-based music playlist. Slide switches 138D,238D may also be used as a light button, which may be used to actuate and control system lights to control brightness, and may synchronize with music and wave action. One of the switches may be used to control the temperature of the system. The system may include other optional enhancements, such as, for example without limitation, internal speakers and a wireless control to access music; and a voice-activated control feature.

The system and its components may be made of any suitable materials, and may be fabricated by any suitable fabrication process.

The shower and bath structures may be a conventional bath with a system housing or a shower structure. The system housing and the shower structure may be made of high tensile strength glass, with water tight doors and seals. The seals may be provided on any system components to provide a water tight environment. The seals may be made of any suitable material such as silicone or silicone rubber. The silicone enclosure may be made of any suitable soft silicone material having properties including durability, high shear strength and soft, skin-like tactile texture. Nonlimiting examples of such a material may include high compliance silicone rubber and/or high consistency silicone rubber having properties including durability, high sheer strength and soft, skin-like tactile texture. The at least one interior membrane may be made of any suitable plastic or silicone material.

The non-Newtonian fluids may be any suitable non-Newtonian fluid having varying viscosities, with varying particulate concentrations, shapes and textures. The non-Newtonian fluids are stable at varying temperatures. The non-Newtonian fluids may be configured to enhance the luxury bath/shower experience. The plurality of balls of different sizes may be provided in different layers of non-Newtonian fluid to vary the experience. The plurality of balls may comprise silicone or rubber balls of any suitable size and dimensions. Nonlimiting examples of suitable silicone or rubber balls may have a size and dimensions ranging from about the size of a grapefruit to about the size of a beach ball.

The adhesives may comprise epoxy resin, which is stable in a moist environment and at varying temperatures.

In some embodiments, the silicone enclosure may further incorporate roller mechanisms, of the kind found in massage chairs. The silicone enclosure may also incorporate panels to create wave effects in the non-Newtonian fluids. The experience may include further system enhancements provided by gentle waves, stretching, and/or massaging effects provided by the action of panels to generate gentle waves in the non-Newtonian fluid, or by agitating different sized balls in deeper layers of the non-Newtonian fluid with underlying rollers.

Figure 10:
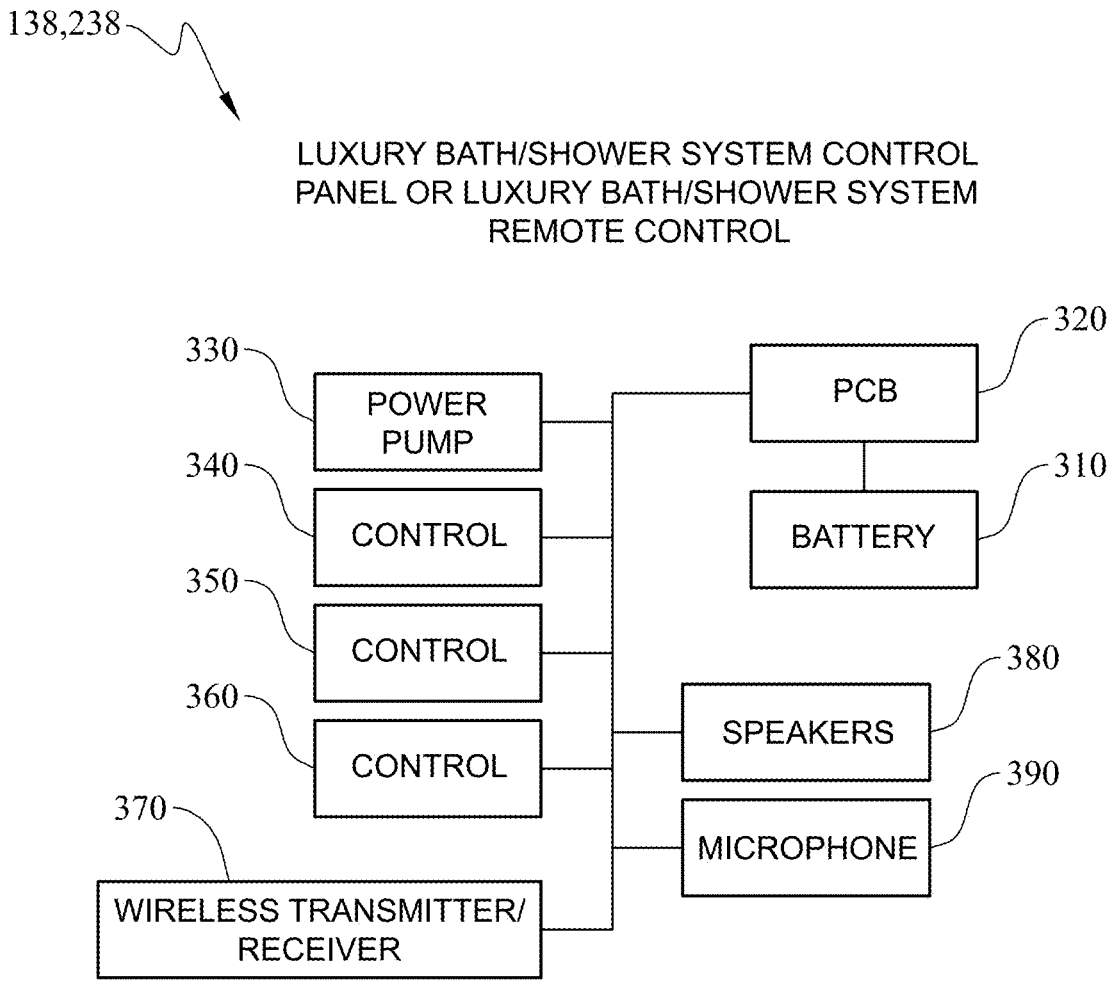
FIG. 10 presents a schematic diagram of a control panel or a remote control of a luxury bath/shower system in accordance with the present invention.

Referring now to FIG. 10, a schematic diagram for the luxe lounge apparatus control panel 138 and the luxe lounge system remote control 238 is shown. The control panel 138 and the system remote control 238 may include a battery power source 310 operably connected to a printed circuit board 320, which is operably connected to a power switch 330, one or more wave controls 340,350, a massage roller apparatus control 360, a wireless transmitter/receiver 370, at least one speaker 380 and a microphone 390.

Figure 11:
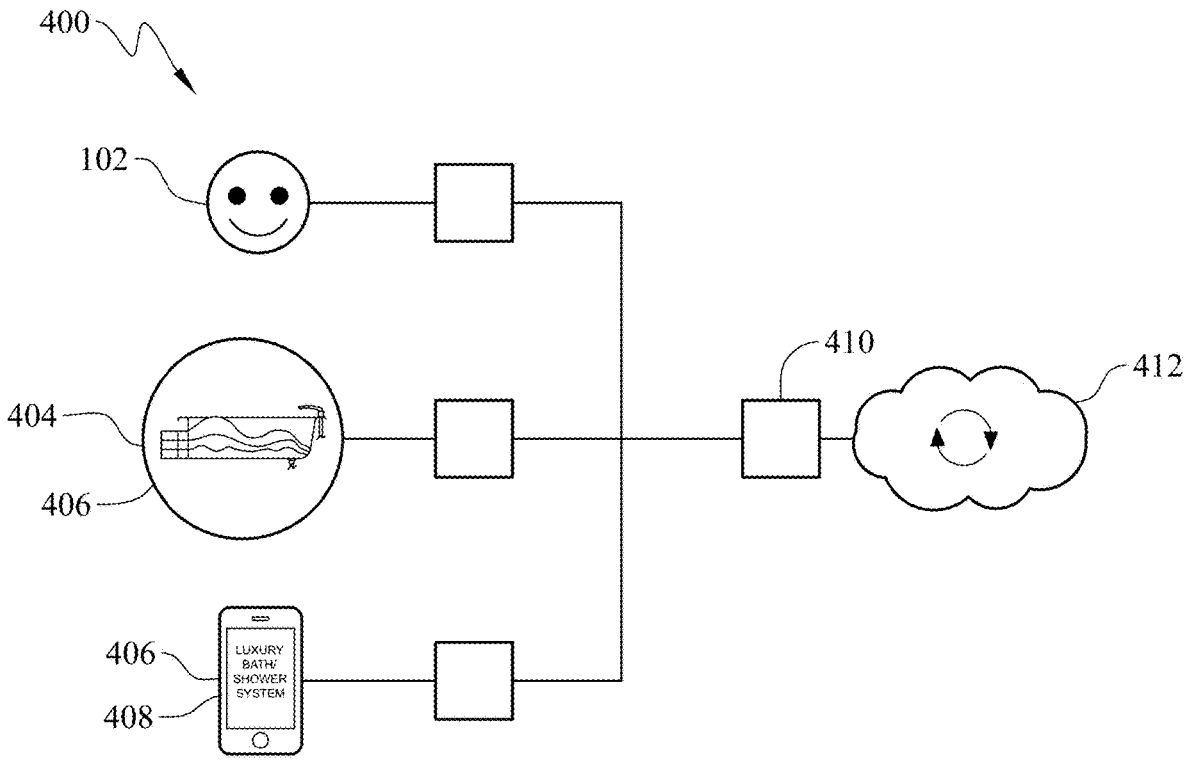
FIG. 11 presents a schematic diagram of a luxury bath/shower system in accordance with an embodiment of the present invention.

Referring next to FIG. 11, a schematic diagram of an exemplary system 400 is shown. The system 400 may be used by an end-user 102. The system 400 may comprise a system computing device 404 in which a system software program 406 is installed. The system computing device may comprise the apparatus control panel 138 or the system remote control 238. The system 400 may include a computing system 408 (in which the system software program 406 is installed), and an administrative system 410 to which the computing device 404 may wirelessly communicate through use of the system software program 406. The computing system 408 may comprise any suitable device, nonlimiting examples of which may be an end-user's mobile phone or tablet. The system 400 may comprise a system database 412 which may be available via the administrative system 410, or on the cloud. The system database 412 may be downloadable to the system computing device 404 or the computing system 408 by using the system software program 406.

In some embodiments the method or methods described herein may be executed or carried out by a computing system including a tangible computer-readable storage medium, also described herein as a storage machine, that holds machine-readable instructions executable by a logic machine (i.e. a processor or programmable control device) to provide, implement, perform, and/or enact the methods, processes and/or tasks described herein. When such methods and processes are implemented, the state of the storage machine may be changed to hold different data. For example, the storage machine may include memory devices such as various hard disk drives, CD, or DVD devices. The logic machine may execute machine-readable instructions via one or more physical information and/or logic processing devices. For example, the logic machine may be configured to execute instructions to perform tasks for a computer program. The logic machine may include one or more processors to execute the machine-readable instructions. The computing system may include a display subsystem to display a graphical user interface (GUI), or any visual element of the methods or processes described herein. For example, the display subsystem, storage machine, and logic machine may be integrated such that the above method may be executed while visual elements of the disclosed system and/or method are displayed on a display screen for user consumption. The computing system may include an input subsystem that receives user input. The input subsystem may be configured to connect to and receive input from devices such as a mouse, keyboard, or gaming controller. For example, a user input may indicate a request that certain task is to be executed by the computing system, such as requesting the computing system to display any of the above-described information, or requesting that the user input updates or modifies existing stored information for processing. A communication subsystem may allow the methods described herein to be executed or provided over a computer network. For example, the communication subsystem may be configured to enable the computing system to communicate with a plurality of personal computing devices. The communication subsystem may include wired and/or wireless communication devices to facilitate networked communication. The described methods or processes may be executed, provided, or implemented for a user or one or more computing devices via a computer-program product such as via an application programming interface (API).

Figure 12:
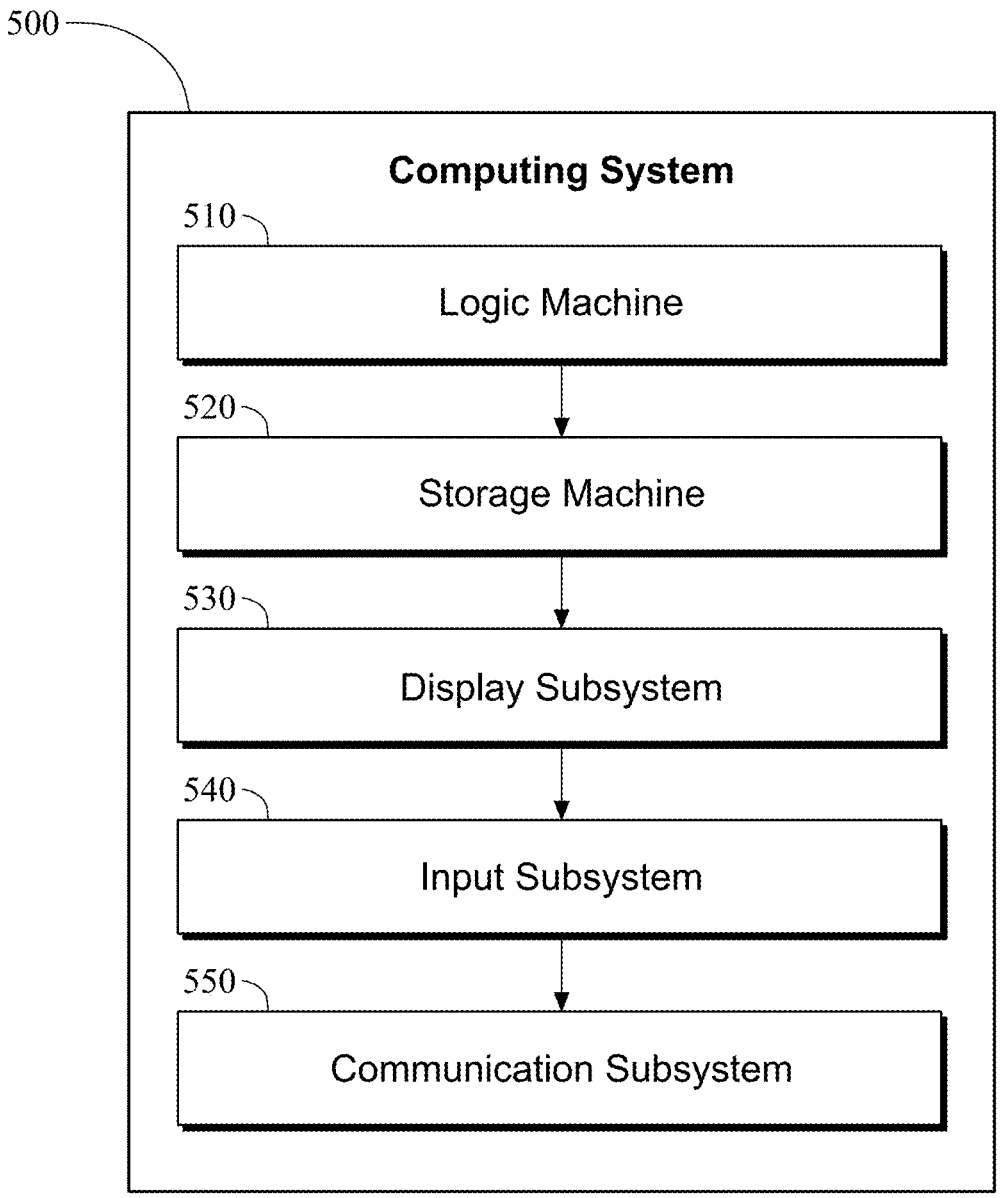
FIG. 12 presents a flow chart of an exemplary computing system of the luxury lounge system in accordance with the present invention.

Referring now to FIG. 12, the illustration schematically presents a computing system 500 that may represent a computing system of luxe lounge system in accordance with an embodiment of the present invention. FIG. 11 schematically shows a non-limiting exemplary embodiment of a computing system 500 that can enact the method of operating the system described herein. The computing system 500 may be any appropriate computing device such as a personal computer, tablet computing device, gaming device or console, mobile computing device, etc. The computing system 500 includes a logic machine 510 and a storage machine 520. The computing system 500 may include a display subsystem 530, an input subsystem 540, and a communication subsystem 550. In some embodiments the methods described herein may be executed on a computing system such as the system computing device 404 which may comprise the system control panel 138 or the apparatus remote control 238, or the computing system 408 of FIG. 10. For example, the storage machine 520 may hold instructions executable by the logic machine 510 to provide the method to users. The display subsystem 530 may display the various elements of the method to users. For example, the display subsystem 530, the storage machine 520, and the logic machine 510 may be integrated such that the method may be executed while being displayed on a display screen. The input subsystem 540 may receive user input from users to indicate the various choices or user inputs described herein. The described method may be executed, provided, or implemented to a user on one or more computing devices via a computer-program product such as via an application programming interface (API). The logic machine 510 may execute machine-readable instructions via one or more physical devices. For example, the logic machine 510 may be configured to execute instructions to perform tasks for a computer program. The logic machine 510 may include one or more processors to execute machine-readable instructions. The storage machine 520 includes one or more physical devices configured to hold or store instructions executable by the logic machine 510 to implement the method. When such methods and processes are implemented, the state of storage machine 520 may be changed to hold different data. For example, the storage machine 520 may include memory devices such as various hard disk drives or CD or DVD devices. The display subsystem 530 may visually present data stored on the storage machine 520. For example, the display subsystem 530 may visually present data to form a graphical user interface (GUI). The input subsystem 540 may be configured to connect and receive input from devices such as a mouse, keyboard, or gaming controller. The communication subsystem 550 may be configured to enable the computing system 500 to communicate with other computing devices. The communication subsystem 550 may include wired and/or wireless communication devices to facilitate networked communication.

In summary, the present invention provides a luxury bath/shower system configured to provide a user an enhanced bath/shower experience to a user, the system comprising:

a bath/shower structure having a frame and an interior portion;

a system housing installed in the frame of the bath/shower structure;

a silicone enclosure configured for storage in the system housing;

an enclosure deployment and retraction apparatus for deployment of the silicone enclosure from a first undeployed enclosure configuration stored within the system housing and a second deployed enclosure configuration deployed to the interior portion of the bath/shower structure; and at least one system control device configured for use by the user to power on the system and to control a plurality of system functions and a plurality of system settings, the at least one system control device being operably connected to the enclosure deployment and retraction apparatus;

wherein the silicone enclosure comprises a sealed exterior compartment and at least one interior membrane of plastic or silicone;

wherein the silicone enclosure and the at least one interior membrane define a plurality of interior compartment layers and a plurality of interior compartments;

wherein each interior compartment of said plurality of interior compartments is configured to contain a quantity of a non-Newtonian fluid;

wherein the plurality of interior compartment layers comprise a first compartment layer and a second compartment layer and the plurality of interior compartments comprise a first interior compartment configured to contain a quantity of a non-Newtonian fluid and a second interior compartment configured to retain a quantity of a non-Newtonian fluid; and wherein a user may operate the system control device to deploy and retract the silicone enclosure;

wherein the enclosure deployment and retraction apparatus comprises:

at least one pump;

a first linear track having a first end and a second end;

a second linear track having a first end and a second end;

a first sled configured for movement on the first track from a first undeployed position at the first end of the first linear track and a second deployed position at the second end of the first linear track;

a second sled configured for movement on the second track from a first undeployed position at the first end of the second linear track and a second deployed position at the second end of the second linear track;

wherein the first sled is attached to the silicone enclosure; and wherein the second sled is attached to the silicone enclosure;

wherein in response to the activation of the enclosure deployment apparatus to operate the at least one pump and to deploy the silicone enclosure, the first sled travels along the first track from the first undeployed position to the second deployed position and the second sled travels along the second track from the first undeployed position to the second deployed position for deployment of the silicone enclosure from the first undeployed enclosure configuration to the second deployed enclosure configuration deployed to the interior portion of the bath/shower structure.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A luxury bath/shower system configured to provide a user an enhanced bath/shower experience to a user, the system comprising:

a bath/shower structure having a frame and an interior portion;

a system housing installed in the frame of the bath/shower structure;

a silicone enclosure configured for storage in the system housing;

an enclosure deployment and retraction apparatus for deployment of the silicone enclosure from a first undeployed enclosure configuration stored within the system housing and a second deployed enclosure configuration deployed to the interior portion of the bath/shower structure; and at least one system control device configured for use by the user to power on the system and to control a plurality of system functions and a plurality of system settings, the at least one system control device being operably connected to the enclosure deployment and retraction apparatus;

wherein the silicone enclosure comprises a sealed exterior compartment and at least one interior membrane of plastic or silicone;

wherein the silicone enclosure and the at least one interior membrane define a plurality of interior compartment layers and a plurality of interior compartments;

wherein each interior compartment of said plurality of interior compartments is configured to contain a quantity of a non-Newtonian fluid;

wherein the plurality of interior compartment layers comprise a first compartment layer and a second compartment layer and the plurality of interior compartments comprise a first interior compartment configured to contain a quantity of a non-Newtonian fluid and a second interior compartment configured to retain a quantity of a non-Newtonian fluid; and wherein a user may operate the system control device to deploy and retract the silicone enclosure;

wherein the enclosure deployment and retraction apparatus comprises:

at least one pump;

a first linear track having a first end and a second end;

a second linear track having a first end and a second end;

a first sled configured for movement on the first track from a first undeployed position at the first end of the first linear track and a second deployed position at the second end of the first linear track;

a second sled configured for movement on the second track from a first undeployed position at the first end of the second linear track and a second deployed position at the second end of the second linear track;

wherein the first sled is attached to the silicone enclosure; and wherein the second sled is attached to the silicone enclosure;

wherein in response to the activation of the enclosure deployment apparatus to operate the at least one pump and to deploy the silicone enclosure, the first sled travels along the first track from the first undeployed position to the second deployed position and the second sled travels along the second track from the first undeployed position to the second deployed position for deployment of the silicone enclosure from the first undeployed enclosure configuration to the second deployed enclosure configuration deployed to the interior portion of the bath/shower structure.

2. The luxury bath/shower system of claim 1, wherein the structural components of the luxury bath system further include fixation means comprising adhesives which are stable in a moist environment, and silicone or rubber balls included in the non-Newtonian fluids.

3. The luxury bath/shower system of claim 1, wherein the system housing of the bath/shower structure is made of high tensile strength glass, and contains water tight doors and seals.

4. The luxury bath/shower system of claim 1, wherein the silicone enclosure is made of a soft silicone material.

5. The luxury bath/shower system of claim 4, the soft silicone material is selected from the group consisting of high compliance silicone rubber and high consistency silicone rubber.

6. The luxury bath/shower system of claim 1, wherein the at least one interior membrane comprises a plurality of interior membranes.

7. The luxury bath/shower system of claim 6, wherein the plurality of interior membranes comprises a first interior membrane and a second interior membrane.

8. The luxury bath/shower system of claim 1, wherein at least one interior compartment contains a plurality of balls.

9. The luxury bath/shower system of claim 1, wherein the plurality of balls comprises three balls.

10. The luxury bath/shower system of claim 1, wherein at least one interior compartment contains a plurality of balls of different sizes which are provided in different layers of non-Newtonian fluid.

11. The luxury bath/shower system of claim 10, wherein, the plurality of balls comprise silicone or rubber balls.

12. The luxury bath/shower system of claim 2, wherein the adhesives comprise epoxy resin.

13. The luxury bath/shower system of claim 1, wherein, the silicone enclosure contains massage roller mechanisms and/or wave effect panels.

14. The luxury bath/shower system of claim 1, wherein system control device and/or the system remote control device, is located in the bath/shower or on a bathroom wall.

15. The luxury bath/shower system of claim 1, wherein the system control device is configured to power on the system and operate the enclosure deployment and retraction apparatus.

16. The luxury bath/shower system of claim 1, wherein the system control device is configured to deploy a plurality of balls to create a floating sensation.

17. The luxury bath/shower system of claim 1, wherein the system control device is configured to provide one or more of a lighting control, a music control and a system temperature control.

18. The luxury bath/shower system of claim 1, wherein the enclosure deployment and retraction apparatus further includes at least one pump.

19. The luxury bath/shower system of claim 18, wherein the at least one pump is configured to retract or undeploy the non-Newtonian fluid in connection with retraction or undeployment of the silicone enclosure.

20. The luxury bath/shower system of claim 1 which is incorporated into a conventional bath tub or a conventional shower.

* * * * *